US007350328B1

(12) United States Patent
Garcia

(10) Patent No.: US 7,350,328 B1
(45) Date of Patent: Apr. 1, 2008

(54) DEPLOYABLE TRAFFIC SIGN

(75) Inventor: Guadalupe C. Garcia, Tijuana (MX)

(73) Assignees: TrafFix Devices, Inc., San Clemente, CA (US); TTB Products, San Clemente, CA (US)

( * ) Notice: Subject to any disclaimer, the term of this patent is extended or adjusted under 35 U.S.C. 154(b) by 0 days.

(21) Appl. No.: 11/041,184

(22) Filed: Jan. 21, 2005

Related U.S. Application Data

(60) Provisional application No. 60/538,445, filed on Jan. 21, 2004.

(51) Int. Cl.
*G09F 15/00* (2006.01)

(52) U.S. Cl. ..... 40/610; 40/612; 116/63 P

(58) Field of Classification Search ..... 40/612, 40/610, 592; 116/63 P
See application file for complete search history.

(56) References Cited

U.S. PATENT DOCUMENTS

| | | | | | |
|---|---|---|---|---|---|
| 2,525,728 | A | * | 10/1950 | Sauer | 248/472 |
| 2,613,463 | A | * | 10/1952 | Transue | 40/610 |
| 3,792,678 | A | * | 2/1974 | Rowland | 116/63 P |
| 4,019,271 | A | | 4/1977 | Latimer | |
| 4,548,379 | A | | 10/1985 | Seely et al. | |
| 4,552,089 | A | * | 11/1985 | Mahoney | 116/63 P |
| 4,575,040 | A | | 3/1986 | Seely | |
| 4,592,158 | A | | 6/1986 | Seely | |
| 4,593,879 | A | | 6/1986 | Seely et al. | |
| 4,619,220 | A | | 10/1986 | Seely et al. | |
| 4,662,095 | A | * | 5/1987 | Higgins | 40/592 |
| 4,691,892 | A | | 9/1987 | Grewe et al. | |
| 4,694,601 | A | | 9/1987 | Dicke et al. | |
| 4,747,515 | A | * | 5/1988 | Kasher et al. | 221/116 |
| 5,054,648 | A | | 10/1991 | Luoma | |
| 5,175,646 | A | | 12/1992 | Eden | |
| 5,213,464 | A | | 5/1993 | Nicholson | |
| 5,244,334 | A | | 9/1993 | Akita et al. | |
| 5,340,068 | A | | 8/1994 | Sarkisian et al. | |
| 5,488,792 | A | * | 2/1996 | Kwok | 40/612 |
| 5,525,021 | A | | 6/1996 | Larguier | |
| 5,598,654 | A | | 2/1997 | Cowgill et al. | |
| 5,694,711 | A | | 12/1997 | Cowgill et al. | |
| 5,725,186 | A | | 3/1998 | Hillstrom et al. | |
| 5,732,911 | A | * | 3/1998 | Kulp et al. | 248/158 |
| 5,829,178 | A | | 11/1998 | Hillstrom | |
| 6,032,908 | A | | 3/2000 | Hillstrom et al. | |
| 6,056,250 | A | | 5/2000 | Hillstrom et al. | |
| 6,183,042 | B1 | | 2/2001 | Unrath | |
| 6,364,400 | B1 | | 4/2002 | Unrath | |
| 6,381,889 | B1 | | 5/2002 | Knapp | |
| 6,430,855 | B1 | | 8/2002 | Gertz et al. | |
| 6,435,369 | B1 | * | 8/2002 | Poursayadi | 221/185 |
| 6,560,906 | B1 | | 5/2003 | Hillstrom | |
| 6,606,809 | B2 | | 8/2003 | Hillstrom et al. | |
| 6,625,912 | B2 | | 9/2003 | Dicke et al. | |

(Continued)

FOREIGN PATENT DOCUMENTS

| | | | |
|---|---|---|---|
| GB | 2186729 | A * | 8/1987 |

*Primary Examiner*—Gary C. Hoge
(74) *Attorney, Agent, or Firm*—Stout, Uxa, Buyan & Mullins, LLP; Donald E. Stout

(57) ABSTRACT

A traffic sign system permits automatic deployment thereof from a moving vehicle. The foldable, spring-loaded sign may be deployed without assembly of the traffic sign at a desired display location.

19 Claims, 15 Drawing Sheets

U.S. PATENT DOCUMENTS

| | | | | |
|---|---|---|---|---|
| 6,659,681 | B1 | 12/2003 | Kulp et al. | |
| 6,752,582 | B2 | 6/2004 | Garcia | |
| 6,928,952 | B2 * | 8/2005 | Garcia | 116/63 C |
| 2002/0121035 | A1 | 9/2002 | Dicke et al. | |
| 2003/0029067 | A1 | 2/2003 | Dorstewiz | |
| 2003/0033743 | A1 | 2/2003 | Hillstrom et al. | |
| 2003/0183740 | A1 | 10/2003 | Knapp et al. | |
| 2003/0217496 | A1 | 11/2003 | Dicke et al. | |
| 2005/0091895 | A1 * | 5/2005 | Garcia | 40/610 |

* cited by examiner

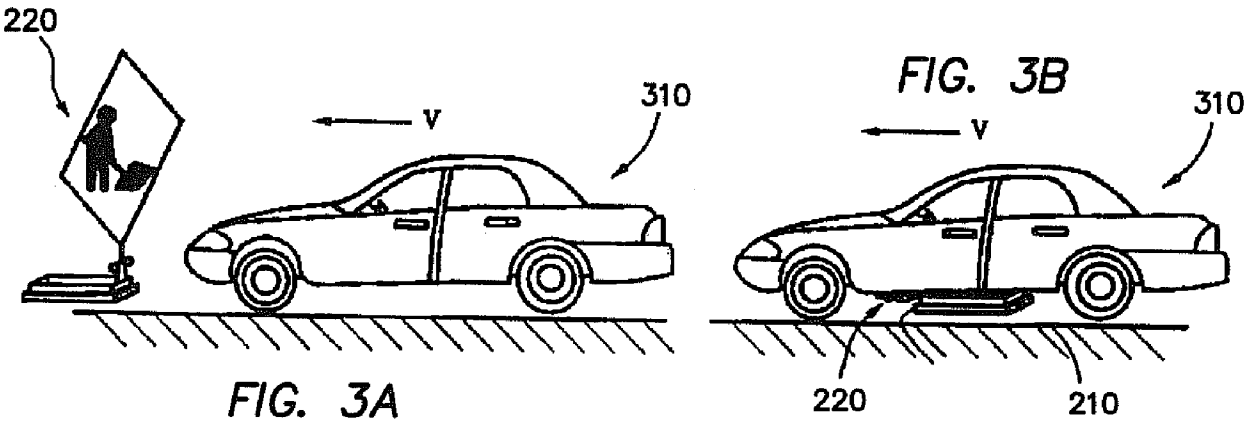
FIG. 3A
FIG. 3B
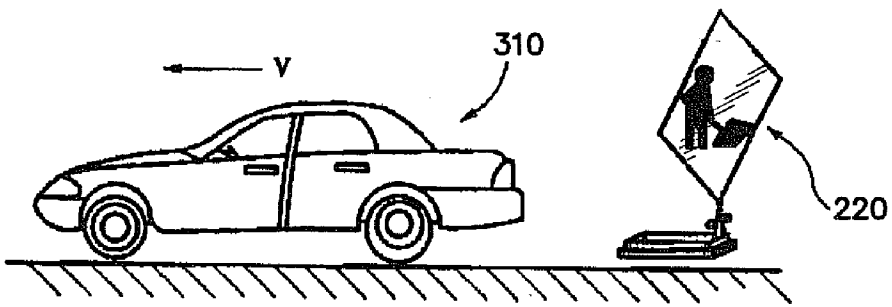
FIG. 3C

FIG. 4B
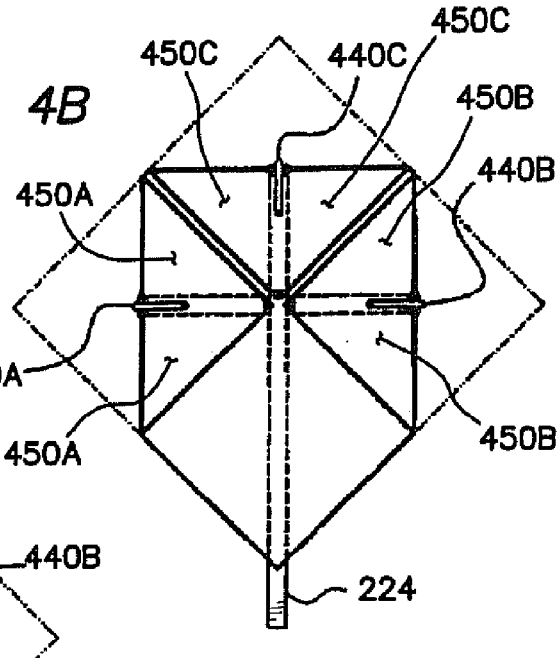
FIG. 4A
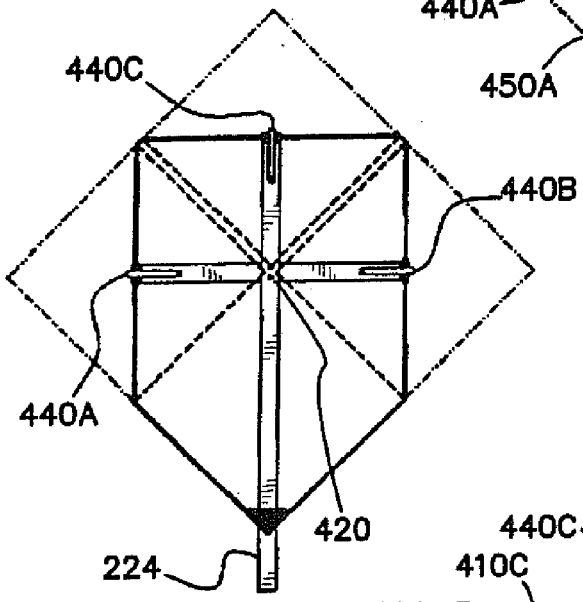
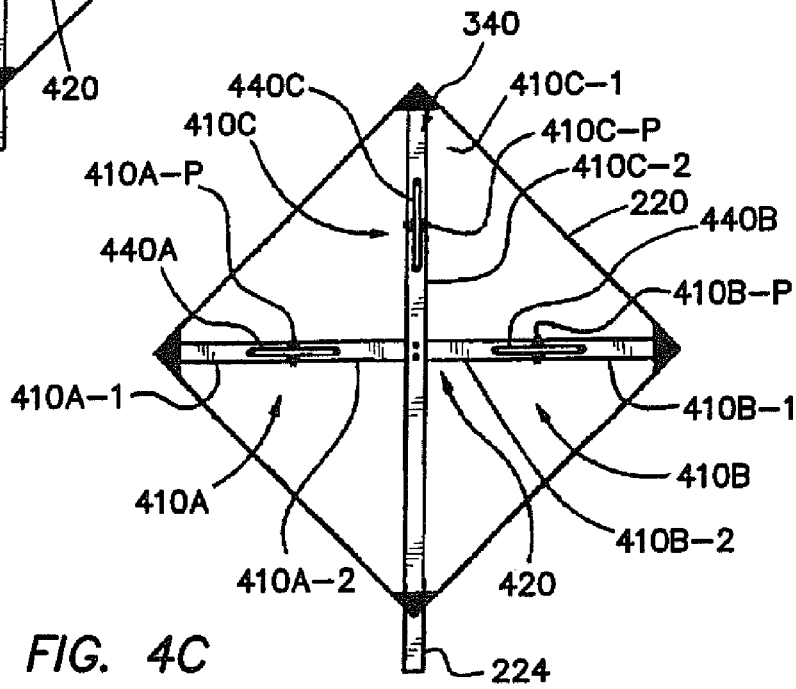
FIG. 4C

FIG. 5A
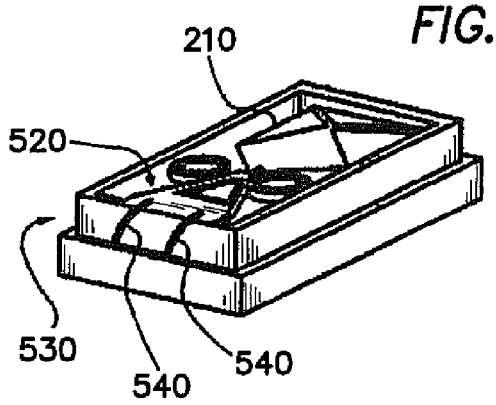
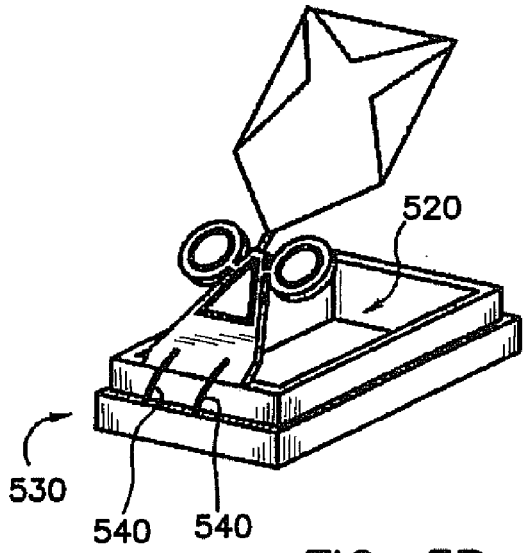
FIG. 5B
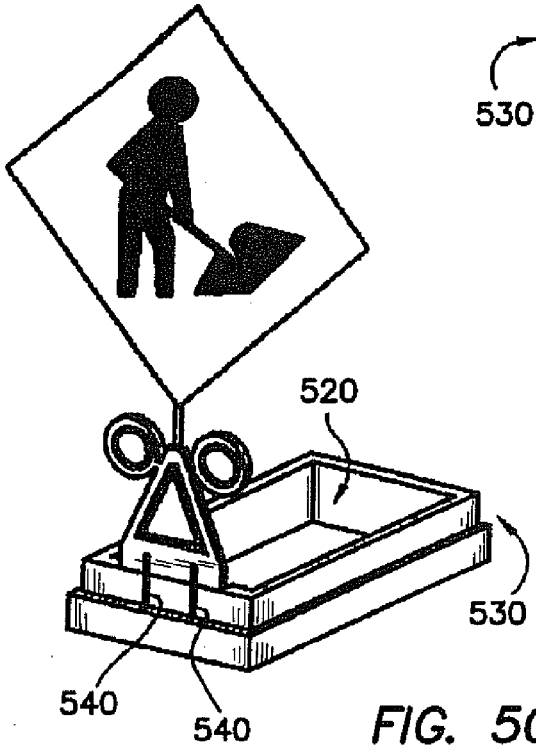
FIG. 5C

FIG. 9A
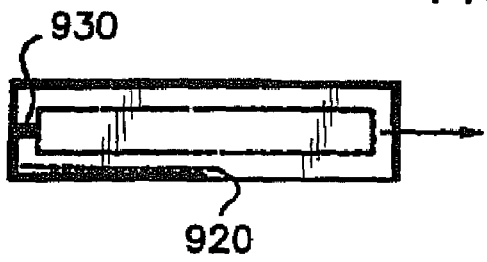
FIG. 9B
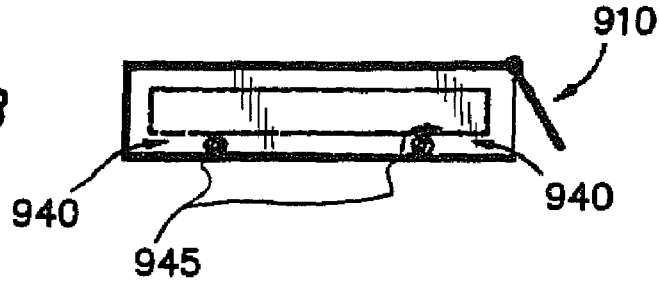
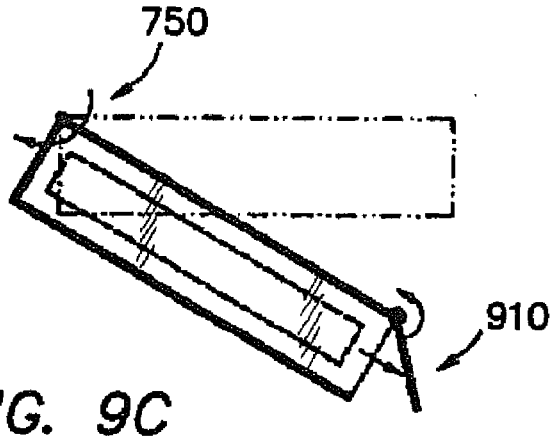
FIG. 9C

FIG. 12A
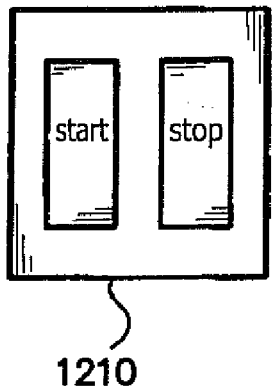
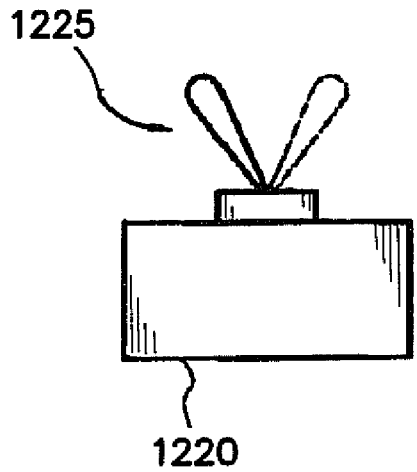
FIG. 12B
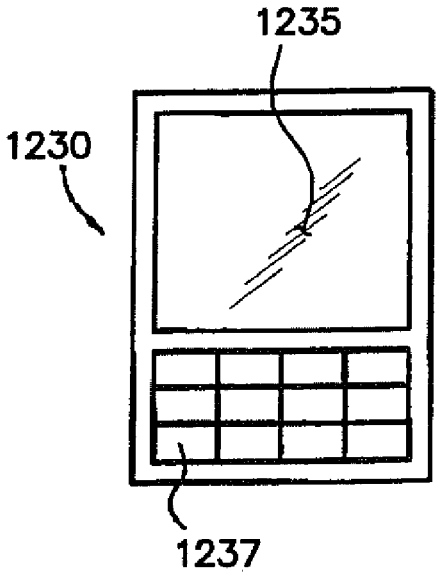
FIG. 12C
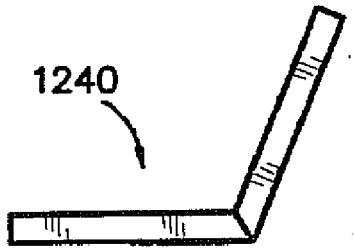
FIG. 12D

DEPLOYABLE TRAFFIC SIGN

This application claims the benefit under 35 U.S.C. 119(e) of the filing date of Provisional U.S. Application Ser. No. 60/538,445, entitled Deployable Traffic Sign, and filed on Jan. 21, 2004, which application is expressly incorporated herein by reference.

BACKGROUND OF THE INVENTION

The present invention relates generally to traffic signs, and more particularly to traffic signs that can be automatically deployed, e.g. from a moving vehicle, and can be deployed without assembly of the traffic sign at the desired display location.

Of major importance today, due to our society's dependence upon motorized transportation, is the continuing construction, repair, and maintenance of freeways, highways, and roads. Involved in all such construction, repair, and maintenance are traffic signs for placement on the roadside ahead of the job site, where motorists can be warned of the presence of road construction equipment, personnel, or hazardous conditions as they approach the work site. To provide motorists with such notification or warning, it is necessary that one or more traffic signs be displayed along the roadside, such signs being located well in advance of the road construction or repair project. One type of traffic sign that is commonly placed along the roadside is the so-called and art-recognized roll-up sign. Examples of prior art roll-up signs are described, for instance, in U.S. Pat. No. 4,019,271 (Laminer), U.S. Pat. No. 4,548,379 (Marketing Displays, Inc.), U.S. Pat. No. 4,694,601 (Dicke Tool Co.), and U.S. Pat. No. 5,732,911 (TrafFix Devices, Inc.). These prior art roll-up signs typically comprise a support stand, such as a one-piece base or a plurality of supporting legs coupled to a frame, and a reflective and flexible sign, which is attached to the frame.

A typical process for placing prior art roll-up traffic safety signs is to deliver a disassembled roll-up sign and support stand to a desired location along a roadside. A worker will then assemble the roll-up sign system and correctly place the sign so that it is properly displayed to passing motorists. Although attempts have been made to simplify this assembly process, most notably in U.S. Pat. No. 5,732,911, manual labor is still required to assemble and place these signs, and the process necessarily places workers at risk, since they must perform this process in close proximity to passing traffic. Accordingly, it would be desirable to develop a roll-up sign which can be automatically deployed without the need of roadside assembly, and preferably from a moving vehicle.

SUMMARY OF THE INVENTION

The present invention comprises a self-deploying traffic sign and methods and apparatus for automatically delivering and placing these self-deploying signs on the roadside, resulting in a faster and safer delivery and placement process.

In one aspect of the invention, there is provided a self-deployable traffic sign system, which comprises a receptacle mountable to a vehicle, a support base, preferably made of rubber, and a reusable foldable sign pivotably mounted to the support base. The sign is pivotable to a spring-loaded storage position adjacent to said base and in the storage position is of a sufficiently small configuration to be disposed within said receptacle. Preferably, the support base comprises an upper surface in which is disposed a recess which is sized to receive the foldable sign therein when the sign is in a folded configuration and when the sign is pivoted to its storage position.

In a preferred embodiment, the receptacle is mounted to a hitch disposed on the vehicle.

More particularly, the foldable sign comprises a foldable sign panel, preferably made of a flexible material, disposed on a foldable sign frame which is pivotably mounted to the support base. The foldable sign frame comprises flexible arms on which the foldable sign panel is mounted. The sign frame further comprises an upright sign post for supporting the flexible arms, as well as a bottom portion, preferably triangular, which is relatively broad in configuration.

A resilient mechanism, preferably a spring or springs, is provided on the support base, for deploying the spring upwardly upon release of the sign from the receptacle, and for also stabilizing the sign when it is deployed in high-wind conditions.

Means is provided for remotely releasing the sign and support base from the receptacle in order to deploy the sign, which means are discussed in detail below. In certain embodiments, the receptacle is pivotable in order to release and deploy the sign. The receptacle may be adapted to contain only a single sign, or, alternatively a plurality of signs.

In another aspect of the invention, there is provided a reusable, foldable traffic safety sign system adapted for being dispensed from a receptacle attached to a vehicle. The sign system comprises a support base, a foldable sign frame pivotably mounted to the support base, and a foldable sign mounted on the sign frame. The sign frame is pivotable to a spring-loaded storage position adjacent to the base and in the storage position is of a sufficiently small configuration to be disposed within the receptacle.

The invention, together with additional features and advantages thereof, may best be understood by reference to the following description taken in conjunction with the accompanying illustrative drawing.

BRIEF DESCRIPTION OF THE DRAWINGS

FIGS. 3A-3C are sequential plan views illustrating a vehicle running into and over a traffic sign such as the sign showed in FIG. 2;

FIG. 4A shows a back view of a foldable frame and sign constructed in accordance with the present invention, in a folded condition;

FIG. 4B shows a front view of the folded frame and sign of FIG. 4A;

FIG. 4C shows a back view of the frame and sign of FIGS. 4A and 4B, with the frame and sign being in an extended condition;

FIG. 5A is a perspective view illustrating a deployable sign of the present invention in a stored position;

FIG. 5B is a perspective view similar to FIG. 5A, illustrating the release of the deployable sign from its stored position;

FIG. 5C is a perspective view similar to FIGS. 5A-B, illustrating the deployable sign in an erected and deployed position;

FIGS. 9A-C are plan views illustrating various embodiments for releasing the traffic sign from its receptacle according to the present invention;

FIGS. 12A-D are schematic plan views of different embodiments of control actuators for use in the embodiment of FIG. 11;

DESCRIPTION OF THE PREFERRED EMBODIMENT

Figure 1A:
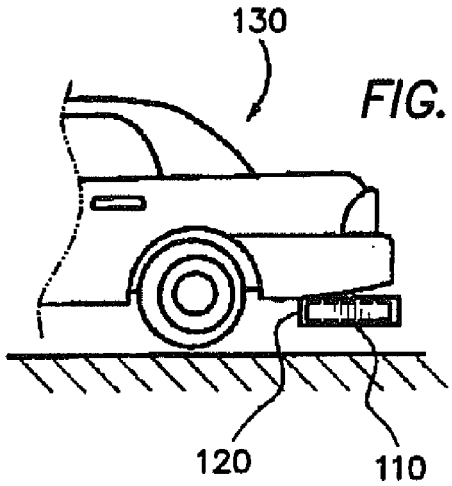
FIG. 1A is a plan view showing one embodiment of a automatic traffic sign deployment device, with the sign in a folded and stored configuration, in accordance with the principles of the present invention.
Figure 1B:
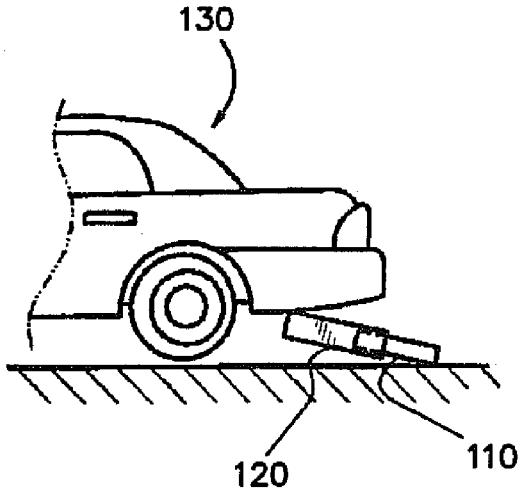
FIG. 1B is a plan view similar to FIG. 1A, showing the receptacle for storing the folded sign in an orientation suitable for deploying the sign therefrom.

Referring now more particularly to the drawings, there is shown in FIG. 1A a self-deployable traffic sign 110 in a folded and spring-loaded condition, within a receptacle 120 which is removably attached to a vehicle 130. As shown in FIG. 1B, an open rear end of the receptacle 120 can be released from its attachment to the underside of the vehicle 130, so that the folded sign 110 slides out of the receptacle, through the open rear end thereof. Then, as illustrated in FIG. 1C, once the sign 110 is fully dispensed or released from the receptacle 120, it pops up, due to its spring-loaded condition, into a fully deployed sign 110.

Figure 1C:
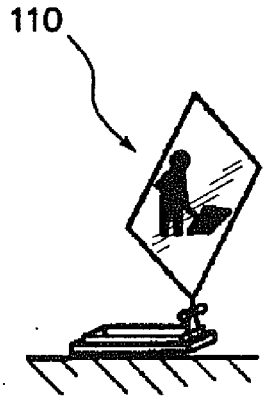
FIG. 1C is a plan view showing the sign of FIGS. 1A-B in a deployed condition on the roadway.
Figure 2:
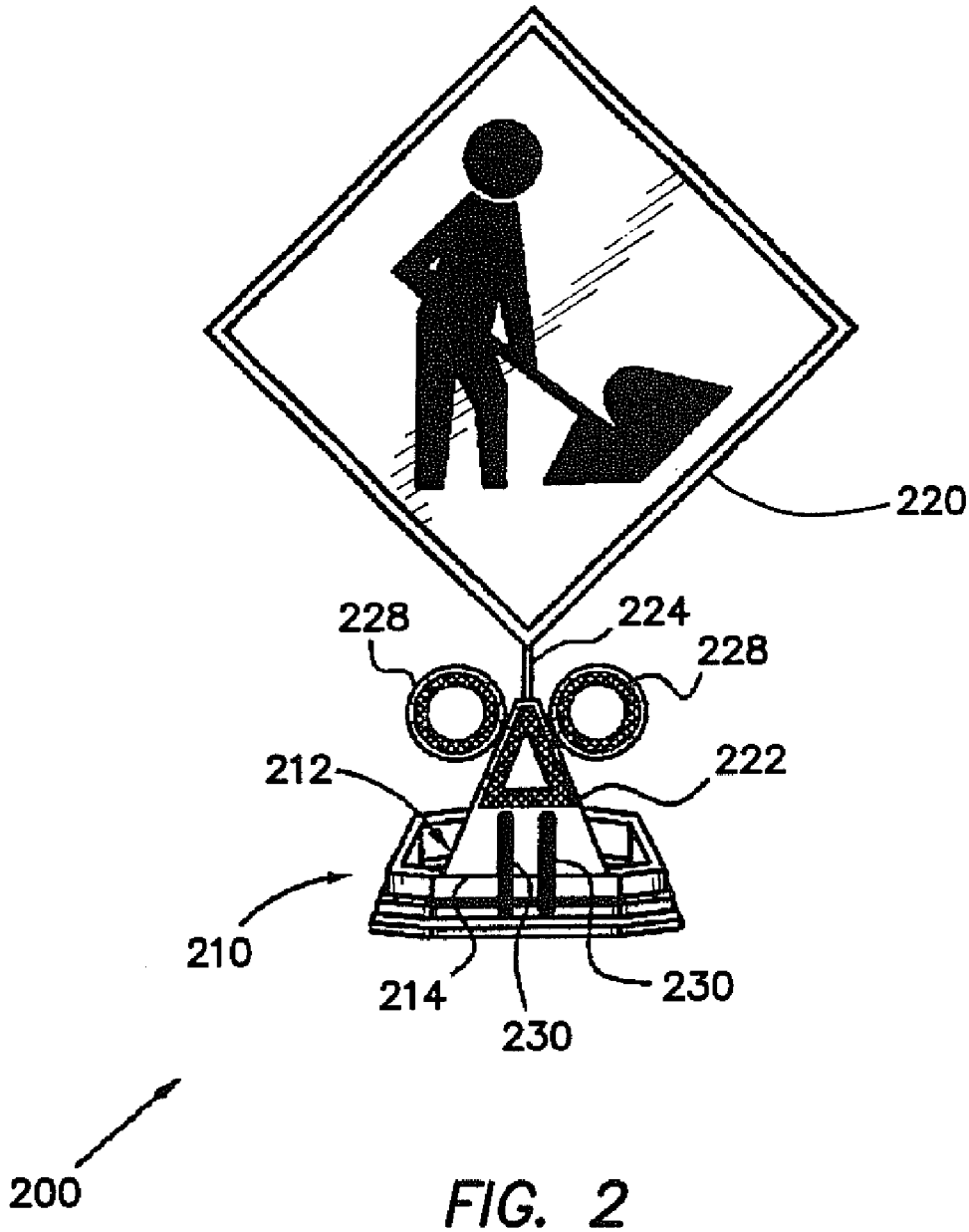
FIG. 2 is a front view of a deployed traffic sign in accordance with the present invention.

In FIG. 2, there is illustrated an embodiment of a traffic sign 200, similar to the traffic sign 110 in FIGS. 1A-1C, in a deployed position. Traffic sign 200 includes a support base 210 having a recess area 212, an end 214, and a deployable sign panel 220. Bottom portion 222 extends upwardly from the base 210, and creates a pivotal connection to the end 214 of the base 210. A sign post 224 extends upwardly from the bottom portion 222 for supporting the deployable sign 220, and includes a frame of flexible arms (not visible in FIG. 2, since they are disposed behind the sign 220), as well as optional warning lights 228. The pivotal connection between the bottom portion 222 and the support base 210 includes a resilient mechanism, preferably comprising one or more springs 230, or a resilient material such as rubber. In any event, the pivotal connection has spring-like resilient properties for reasons to be described below.

In operation, when it is desired to store and/or transport the sign 220, it may be pivoted downwardly by pivoting bottom portion 222 so that the sign 220 and associated frame 224 are entirely disposed within the recess area 212. The sign 220 may be retained within the recess area 212, against the applied force created by the springs 230, either by means of a retaining latch (not shown), or by tucking an edge of the sign 220 underneath a ledge (not shown) disposed along an edge of the recess area 212. When it is desired to release the sign 220 to its deployed position, as shown in FIG. 2, the sign needs only to be released from the recess area, by undoing the latch or causing the edge of the sign to be removed from beneath the ledge. Since the springs 230 are loaded, the sign will automatically spring upwardly to its deployed position upon release.

In addition to the foregoing benefit of the springs 230, the springs also preferably function to offset movements of the sign caused by such effects as the wind and passing traffic, thus assisting in keeping the sign in a functional orientation. Moreover, in the case of direct and/or high impact perturbations, such as would be the case if an approaching vehicle 310 (FIG. 3A) were to strike the deployed sign 220 (FIG. 3B), causing the sign to be pivoted to a horizontal orientation beneath the vehicle, as shown, the resiliency of the springs 230 have an impulse response fast enough to cause the sign 220 to quick deflect to the horizontal position, upon impact, and then rebound to the deployed position, without substantive damage.

Support base 210 provides ballast for the sign 220, and preferably has sufficient weight to provide stable support to the traffic sign when deployed, and to meet all highway regulation requirements for their desired application. The weight of the support base should also be sufficient to facilitate the release of the traffic sign from the 120 (FIGS. 1A-C), because of gravitational forces, and the material of the support base 210 is preferably rubber, and more preferably recycled rubber. The recess area 212 should provide sufficient space to store deployable sign 220 when it is disposed in its stored position.

In the illustrated embodiment, bottom portion 222 is configured as a triangle, and is preferably sized to permit its surface to accommodate a traffic sign or notice to motorists. In reality, however, it is within the scope of the invention to fabricate the bottom portion 222 of any desired shape, and could be made of any suitable material, although rubber (particularly recycled rubber) is preferred. The bottom portion 222 could also be alternatively fabricated of any suitable pivotable connection, well known in the art.

Sign 220 is a large flexible panel, typically made of fabric or plastic, and accommodating a warning message or symbol preferably conforming to federal or state regulatory requirements. It may accommodate either rolling up, or folding along predetermined crease lines, in order to expedite storage of same under certain circumstances. The folding lines, if supplied, would help to prevent damage to retroreflective material on the display portion of the sign. Referring now to FIGS. 4A-C, the sign post 224 forms part of a frame 340 comprising flexible arms 410A, 410B, and 410C, to which the sign 220 may be attached in a manner well known in the prior art.

As is obvious from the drawings, the fully deployed sign 220 is too large to fit within the recess area 212 in the support base 210, for storage purposes. Therefore, the frame 340 is designed to be foldable to a size such that the flexible arms 410A, 410B, and 410C will fit inside the recess area 212. Folding of the frame is achieved by having each of the flexible arms 410A, 410B, 410C be capable of being independently folded about points 410A-P, 410B-P, and 410C-P, toward the center 420 of the frame. This folding process is shown in FIGS. 4A and 4B. The folding process for each of the flexible arms 410A, 410B, 410C is established by folding arm part 410A-1 toward arm part 410A-2, folding arm part 410B-1 toward arm part 410B-2, and folding arm part 410C-1 toward arm part 410C. Flexible parts 440A, 440B, 440C connect arm parts 410A-1 to 410A-2, 410B-1 to 410B-2, and 410C-1 to 410C-2, respectively.

Without posing any limitation to the invention, an efficient way to reduce the size of the sign and frame is to have the folding points for each flexible arm located at between length L and ½ L, measured from the center 420, where length L is the length of the flexible arm. When folding the flexible arms as shown in FIGS. 4A and 4B, the folded sign has three folded parts 450A, 450B, 450C. However, it is also possible for the folded parts to overlap each other, depending upon the location of the folding points. It should be noted that is possible to create a different folding pattern than is shown in FIG. 4. The type of frame construction may dictate the choice of folding pattern of the frame and sign. For instance, instead of a cruciform frame, one could use a different frame setup. In any case, the sign should allow for the creation of these folds and preferably these folds should not deteriorate the fluorescent and/or reflective characteristics of the sign.

The sign post 224 and the flexible arm parts may be made of any material which has sufficient strength so that it does not irreversibly deform or break during the use of the traffic sign, storing process, deployment process, and/or perturbations. Suitable materials, for instance, may include metal, fiberglass, graphite, carbon, plastics, combinations of the foregoing materials, or other suitable materials known to those skilled in the art. Note that member 410C-2 may be an extension of sign post 224, or could be integral thereto.

The flexible parts may be fabricated of a rubber bar, a spring mechanism, or any other suitable material which meets functional requirements. The spring or stiffness characteristics of materials suitable for the flexible parts 440A, 440B, 440C must meet the following requirements: a) the neutral or original spring position of the flexible part 440A, 440B, 440C is when the combinations of arm parts 410A-1 and 410A-2, 410B-1 and 410B-2, and 410C-1 and 410C-2 are in an extended position as shown in FIG. 4C.

In FIG. 5A, there is shown a deployable sign 510 of the present invention which is stored in the recess area 520 of a support base 530. First, the deployable sign as a whole is spring-loaded in this stored position by means of pivotal connection 540. Second, the flexible arms holding the sign are spring-loaded and folded in a compact manner as shown in the figure. This stored position may be maintained simply by having the traffic sign held within the recess area because of an interference fit between a portion of the sign frame and the recess area boundaries, or, more likely, because of a latch or other suitable retaining device that can be automatically released when the traffic sign is to be released from the receptacle. Once the stored traffic sign is released from the receptacle, the deployable sign 510 begins to extend, as shown in FIG. 5B, until it is fully deployed, as shown in FIG. 5C. During this process, the flexible arms open up to form a fully extended frame, with each folded part of the frame and sign opening up in an automatic fashion because of spring mechanisms in the folding points 410A-P, 410B-P, and 410C-P.

Figure 6A:
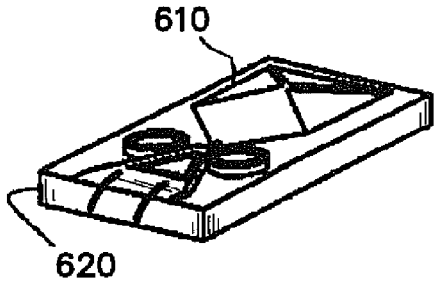
FIG. 6A is a perspective view similar to FIG. 5A illustrating a modified deployable sign in its stored position.
Figure 6B:
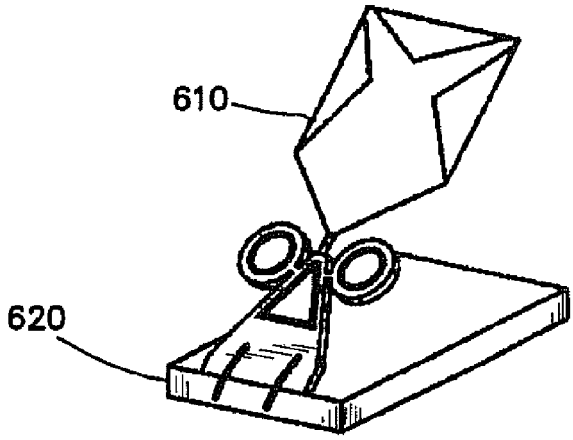
FIG. 6B is a perspective view similar to FIG. 5B, illustrating the deployable sign of FIG. 6A as it is released from its stored position.
Figure 6C:
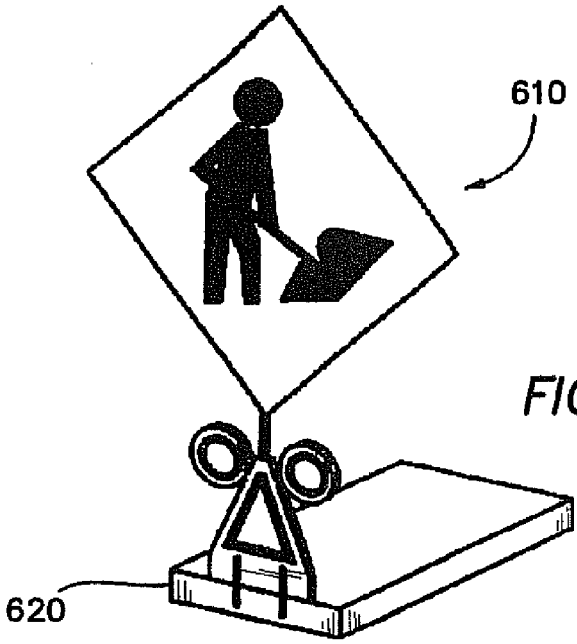
FIG. 6C is a perspective view similar to FIG. 5C, illustrating the deployable sign of FIGS. 6A and 6B in an erected and deployed position.
Figure 7C:
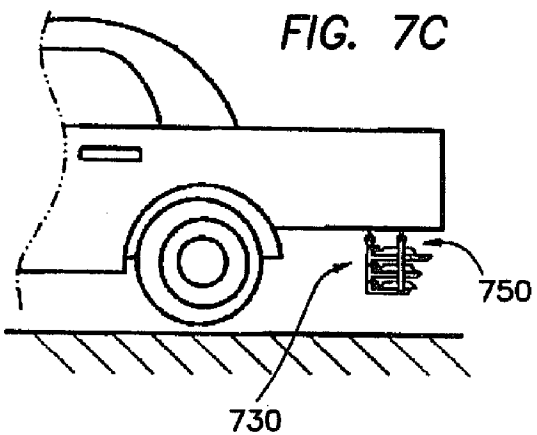
FIGS. 7A-D are plan views illustrating various embodiments of a receptacle for deployable sign system mountable in different ways on a vehicle for deployment.
Figure 7D:
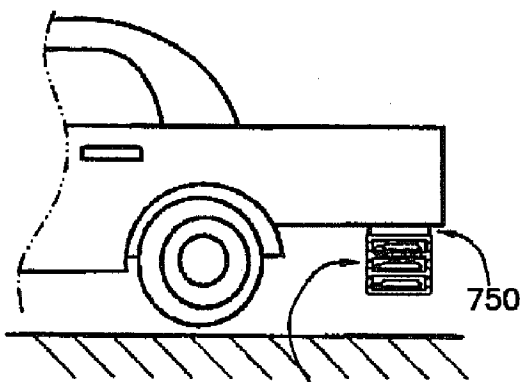
Figure 7A:
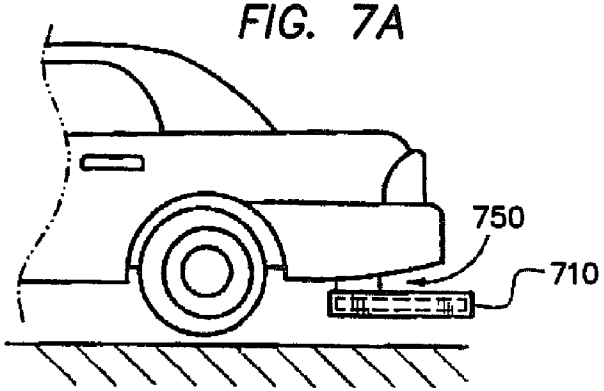
Figure 7B:
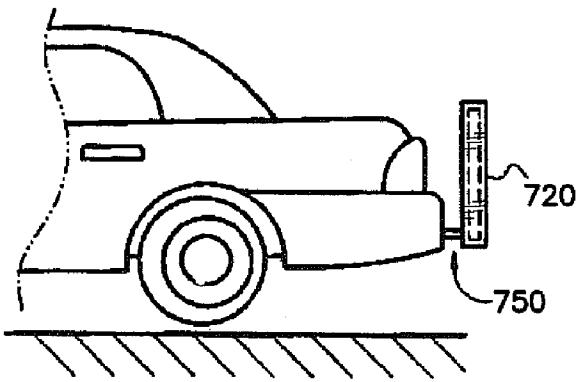

In FIGS. 6A-C, a deployable traffic sign 610 is illustrated, which is similar in all respects to sign 510 in FIGS. 5A-C, except that the support base 620 of deployable traffic sign 610 does not include a recess area. In the embodiment of FIGS. 6A-C, the sign 610 is stored atop substantially flat support base 620.

Referring again to FIG. 2, lights 228 may be one or more lights attached to bottom portion 222. In one aspect, the lights may be positioned preferably not higher than an average height of the bumper of vehicles. The reason for this placement is that once a vehicle hits the sign, it hits above the lights 228, thereby sparing the lights from damage due to impact. The lights are preferably operated by batteries, and are arranged to be actuated to an "on" position upon deployment of the sign.

FIGS. 7A-D illustrates four different receptacle embodiments 710, 720, 730, 740, respectively, and their positioning on a typical vehicle. The receptacle may take various forms and shapes within the scope of the invention. The receptacle may also be a closed system, such as receptacles 710, 720, or 740, or an open system such as receptacle 730. There are also a number of different ways to attach such a receptacle to a vehicle. The type of vehicle or the purpose of the vehicle might play a role in the design of the receptacle and may also determine if it is desired to have the receptacle hold just one traffic sign (receptacles 710, 720), or multiple traffic signs (730, 740). For instance, several traffic signs may be deployed during a single event or during a work shift. Each tray in receptacles 730, 740 may have a specific traffic sign, for instance, with the sign displaying different warnings or messages to the motorist.

Figure 8:
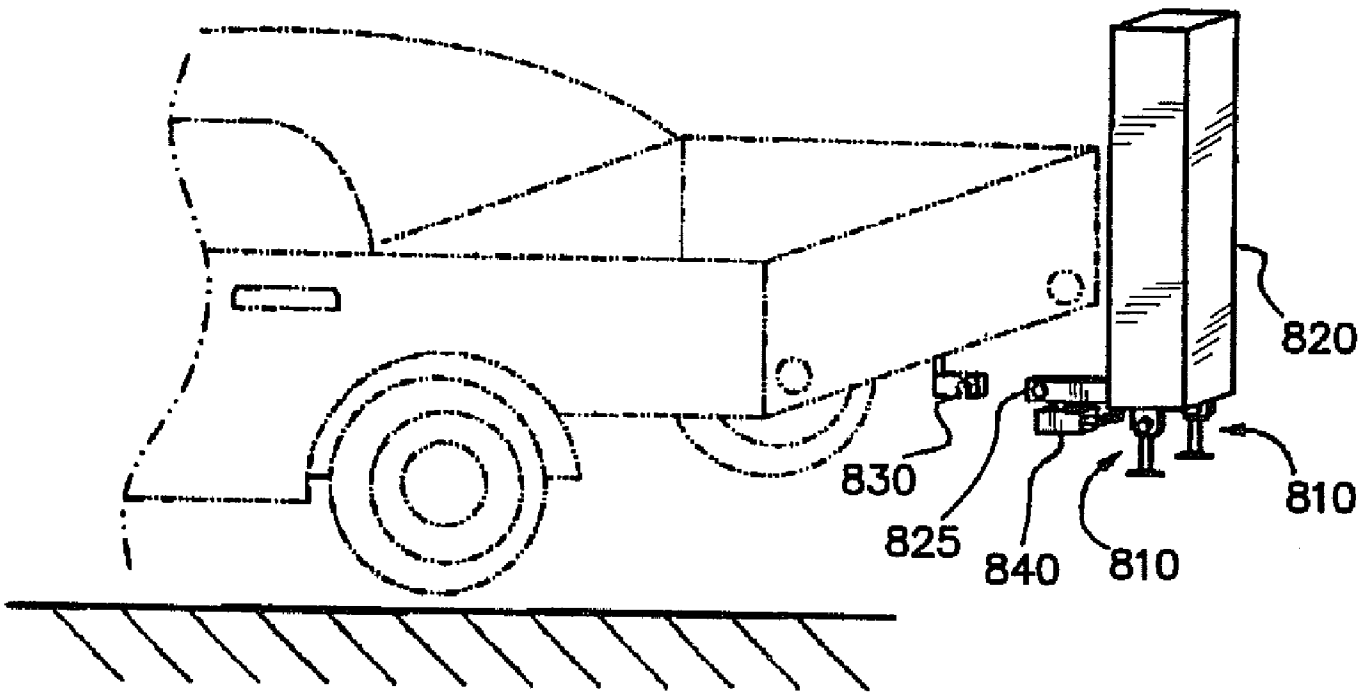
FIG. 8 is a perspective view of a vehicle to which is mounted a receptacle with legs, in accordance with the principles of the present invention.

It is noted that even though a sedan is illustrated as the vehicle in this application, any type of vehicle, including trucks and the like as well as various types of cars, may be utilized. The receptacle is preferably positioned near the end of the vehicle and behind the rear wheels, and either beneath the vehicle (710, 730, 740) or behind the vehicle (720). The receptacle may be permanently attached to the vehicle, but is preferably removably attached, such as by a hitch or the like (FIG. 8). A movable engagement device 750 may be employed to move the receptacle relative to the vehicle, in order to facilitate alignment of the receptacle to the road surface for release of the traffic sign. Such movable engagement devices 750 may include, for example, hydraulic systems, linear motor systems, controllable telescopic arms, controllable segmented arms, or the like, so that the receptacle may be moved/rotated toward the road surface. The movable engagement device 750 may be integrated with the hitch in case the attachment is made through the hitch, or integrated with the attachment itself, as a person of skill in the art will readily appreciate.

The hitch embodiment mentioned above is illustrated in FIG. 8. As shown, in case the receptacle may be removed from the vehicle, it may be desirable to optionally include legs 810 beneath the receptacle 820, as shown in FIG. 8, so that the receptacle may stand upon its legs 810. The legs are useful to store the receptacle at a parking area, a facility, or a rental place. A vehicle may then back up to the standing receptacle and easily connect to the receptacle through a part 825 to its hitch 830 or any other applicable attaching means, and vice versa. The legs are preferably pivotally connected to the bottom of the receptacle and may be folded to a position so that they do not intervene with the operation of the receptacle. The legs may be folded in a manual manner or automatically using a hydraulic or motorized system 840 that can be controlled by a suitable controller.

The release of the traffic sign from its receptacle may be accomplished in a variety of ways as shown in some exemplary embodiments in FIGS. 9A-C. In case of a closed receptacle, an opening is provided near the end or bottom thereof to release the traffic sign. This may be, for instance, a pivoting door 910 (FIG. 9B) or a sliding door 920 (FIG. 9A), which may be operated by the aforementioned controller. The opening should provide sufficient space for the traffic sign to get released. With the opening present, the release could then be accomplished by relying on gravity to do the work for sliding the traffic sign out of the receptacle. Another way is to use a spring mechanism or hydraulic system 930 (FIG. 9A) to push the sign out from the receptacle. Still a third possibility, among many which fall within the scope of the present invention, is a conveyor-belt-like mechanism 940 (FIG. 9B) with wheels 945 dr the like disposed inside the receptacle to translate the traffic sign out from the receptacle.

Figure 10:
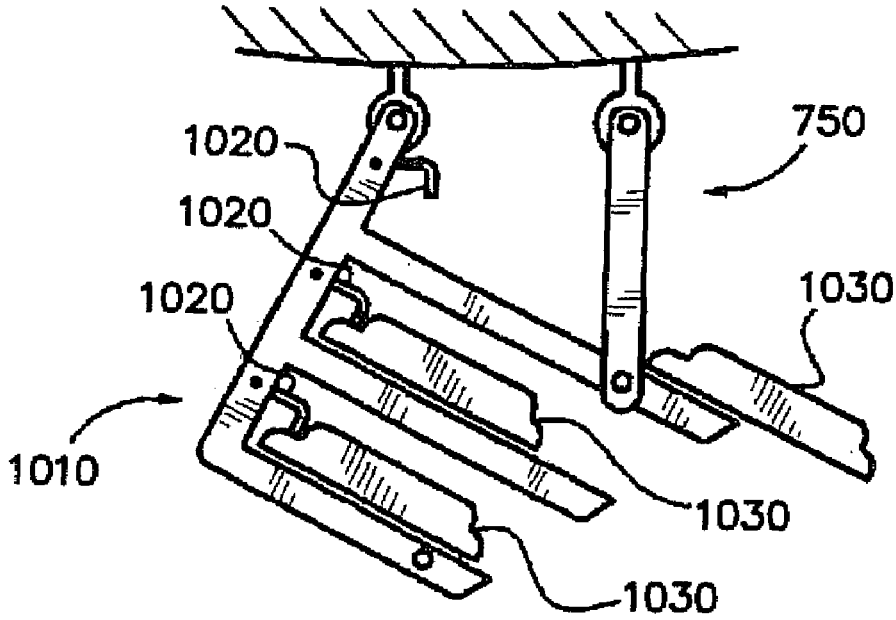
FIG. 10 is a plan view showing a suitable release mechanism for use with an open receptacle system according to the invention.

In case the receptacle is an open system with trays, such as receptacle 1010 shown in FIG. 10, it is necessary to include a latch 1020 for each traffic sign 1030, to hold it in place and prevent it from accidentally releasing while driving. Each traffic sign may then have an opening sized to fit the latch 1020. Latch 1020 is movably attached to receptacle 1010.

The different operations of the receptacle and release of the stored traffic sign is preferably accomplished in an automatic fashion via a controller controlling the different portions of the inventive system, as already described above. For example, the controller may control: a) the retraction or deployment of the legs underneath the receptacle, b) the movement or positioning of the receptacle, c) the desired traffic sign to be released in case of multiple traffic signs being stored therein, d) the door mechanism in case the receptacle is a closed system, e) the latch holding the traffic sign, and/or f) the spring-release, hydraulic system, or conveyor-belt-like mechanism that assists in releasing the traffic sign from the receptacle.

Figure 11:
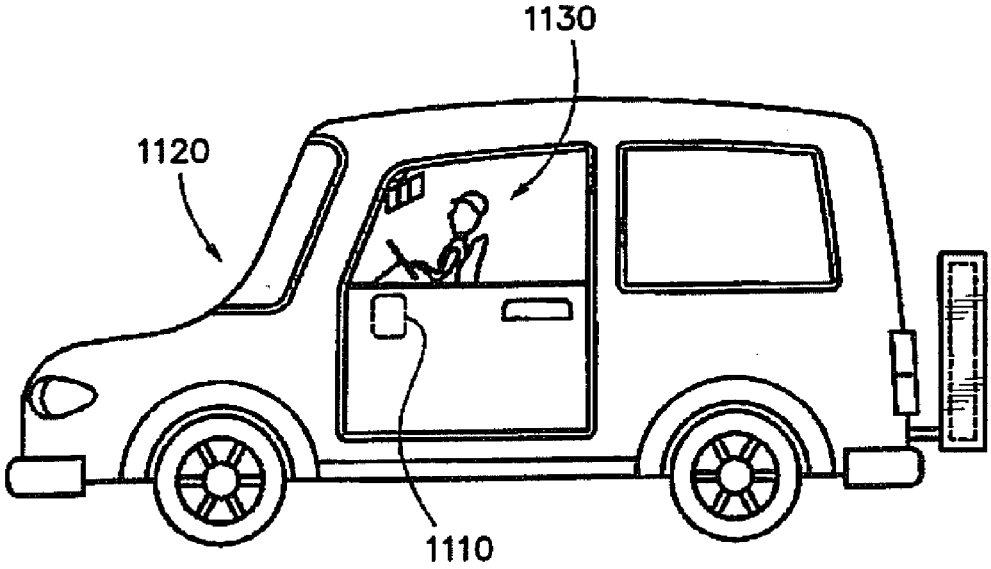
FIG. 11 is a plan view of a vehicle having a control actuator adjacent to the drive for operating a release mechanism in accordance with the present invention.

The controller may include a control device which may be in close proximity to the receptacle or integrated with the receptacle. However, the present invention is not limited to the position of the control device relative to the receptacle as long as the control device can be controlled or operated by a user. However, having control device 1110 in close proximity to the driver of a vehicle 1120, as shown in FIG. 11, somewhere in the cabin or driver's area 1130, is preferred, so that the driver may be able to continue driving safely. The control device communicates with the control parts on the receptacle either via an electrical wire connection or a wireless connection.

FIGS. 12A-C illustrate various possible control devices, which may include a small touch screen panel 1210, a switch box 1220 with one or more switches 1225, or the like. However, the control device is not limited to these embodiments, since it could also comprise a personal digital assistant 1230 with a touch-screen or display 1235 and a keyboard 1237, or other computer device 1240, such as, but not limited to, a laptop to communicate with the controls at the receptacle. Further, the control device may be configured to receive voice commands, as is known in the art.

If desired, the control system may be configured to automatically control the timing of subsequent traffic signs once a "start" signal has been provided. For instance, one or more sensors that could provide distance information to the controller could be used to sense the distance traveled by the vehicle and the, based on the distance traveled, control the next release. In one embodiment, this could occur using the cruise control of the vehicle. In an example of such a more sophisticated controller, the controller only triggers the start of the release of the first traffic sign, and the subsequent release of other traffic signs follows automatically, with the signs (or any other traffic safety equipment being dispensed) being released and placed at a preferred distance from one another. The distance can, for example, be programmed or preset in the controller, since it can be easily gathered or calculated by the controller, given the feedback or sensory information over the distance, time, and/or speed that the vehicle has traveled. Another example is that the controller could include one or more schedules to schedule the release and delivery that may either be programmed or entered for a particular event through a user interface, graphical user interface or touch panel. In other words, a user may either manually control the release(s), or may control an automatic release schedule, whereby the automatic release schedule includes a small control program using sensory or feedback information as input and control signals to control means as output. The present invention may also include sensors that check or verify whether a traffic sign is actually released or placed correctly. Examples of such sensors are, for instance, different types of optical sensors or pressure sensors.

Figure 13:
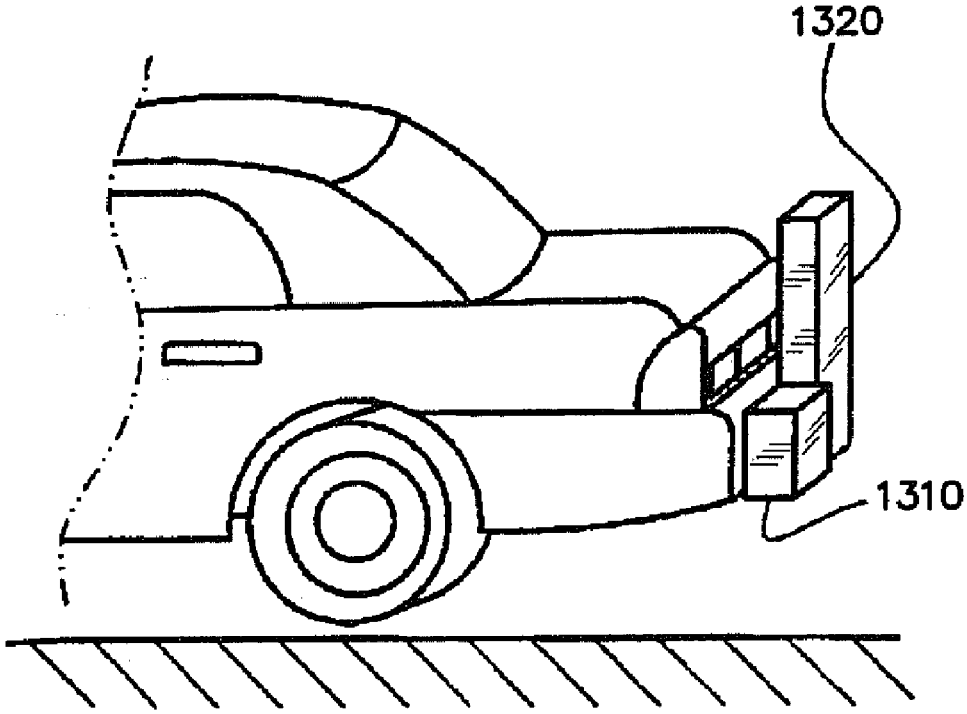
FIG. 13 is a perspective view of a vehicle having both a safety cone dispenser and a sign dispenser mounted thereon.
Figure 14:
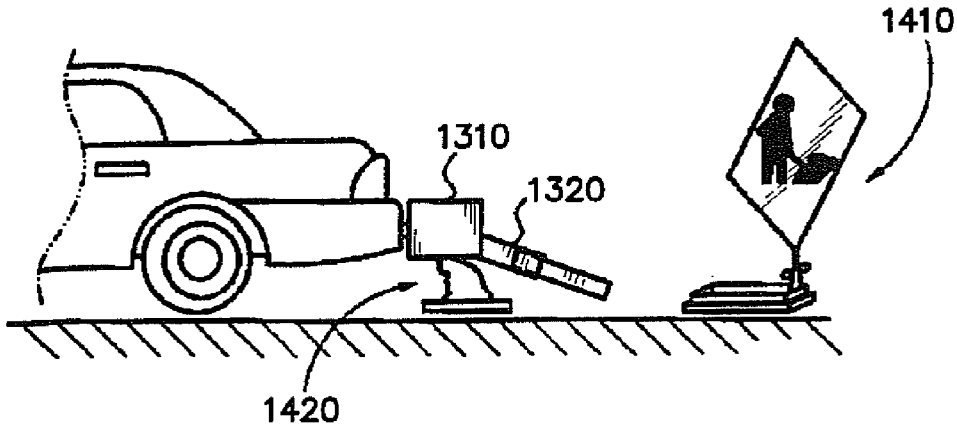
FIG. 14 is a plan view showing the vehicle of FIG. 13 after both a safety cone and a traffic sign have each been dispensed therefrom.

It should be noted that the present invention may be used in combination with a safety cone delivery device, which automatically releases flexible safety cone(s) from its receptacle to a road surface, as described in co-pending U.S. patent application Ser. No. 10/194,709, filed on Jul. 12, 2002 by the same inventor as in the present application, which application is herein expressly incorporated by reference. The two different devices, i.e. the cone dispenser 1310 and the sign dispenser 1320 as shown in FIG. 13, may be used simultaneously or sequentially, depending upon a desired placement of the respective cones and signs. For example, as shown in FIG. 14, it may be desirable to first place a traffic sign 1410, and thereafter one or more cones 1420 to block the road. The controller for each dispenser may be separate or integrated, as desired.

Figure 15A:
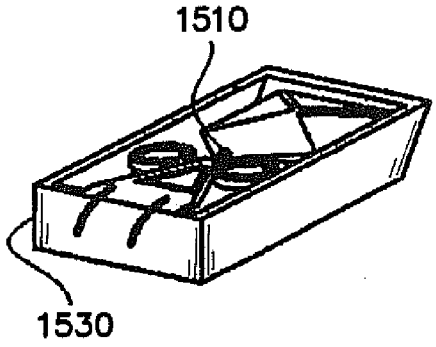
FIGS. 15A-C are sequential perspective views illustrating the deployment of a spring-loadable sign system in accordance with the present invention.
Figure 15B:
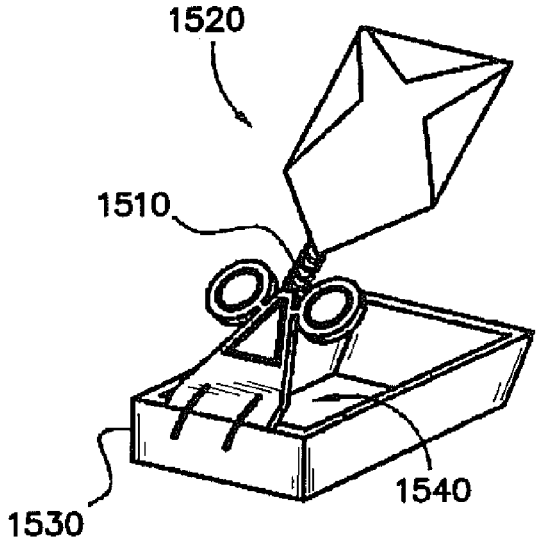
Figure 15C:
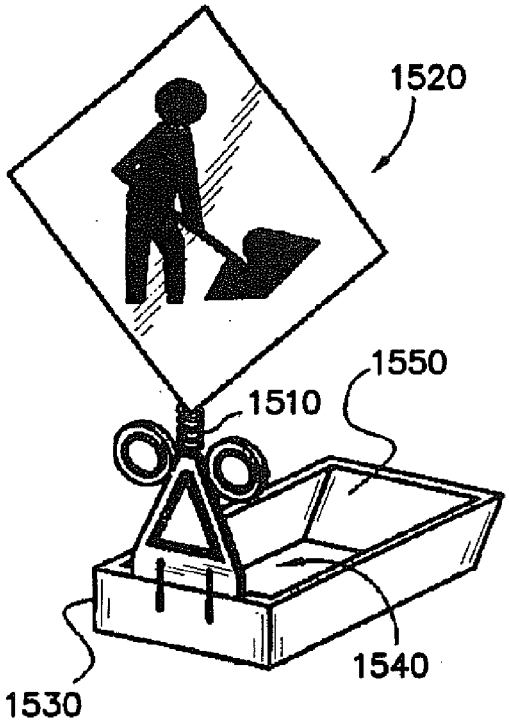

Another variation may be to include a spring, spring mechanism, or telescopic-spring mechanism 1510 (FIGS. 15A-C) that fully or partially replaces the sign post and which can be pushed down along its length toward the support base 1530. This reduces the height of the deployable sign 1520 and then allows for a smaller length of the support base 1530. The spring-loaded deployable sign with the sign post now also spring-loaded could be stored inside the recess area 1540 of support base 1520 or inside the receptacle in case a support base without a recess area is used. In the case of a recess area, it might be preferred to slightly slant the wall 1550 under an angle so that the push-force caused by the sign post spring mechanism in its stored position does not obstruct or prevent the release of the deployable sign. The idea behind the spring-loaded sign post is that it should enhance the release of the deployable sign through its own spring release.

Advantages of the present invention include:

a) storage of an assembled traffic sign in a spring-loaded and compact manner in a receptacle;

b) delivery of the assembled and spring-loaded traffic sign to a desired location along a roadside by a moving vehicle;

c) automatic placement and deployment of the assembled traffic sign to a functional traffic sign from the moving vehicle; and d) control of delivery and placement of a traffic sign by a person from a moving vehicle.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A self-deployable traffic sign system, comprising:

a receptacle mountable to a vehicle;

a support base; and a reusable foldable sign panel comprising a flexible material and being disposed on a foldable sign frame which is pivotably mounted to said support base;

wherein said sign panel is pivotable to a spring-loaded storage position adjacent to said base and in the storage position is of a sufficiently small configuration to be disposed within said receptacle.

2. The self-deployable traffic sign system as recited in claim 1, wherein said support base comprises an upper surface in which is disposed a recess which is sized to receive said foldable sign panel therein when the sign panel is in a folded configuration and when the sign panel is pivoted to its storage position.

3. The self-deployable traffic sign system as recited in claim 2, wherein the support base is comprised of rubber.

4. The self-deployable traffic sign system as recited in claim 1, wherein said receptacle is mounted to a hitch disposed on said vehicle.

5. The self-deployable traffic sign system as recited in claim 1, wherein said foldable sign frame comprises flexible arms on which said foldable sign panel is mounted.

6. The self-deployable traffic sign system as recited in claim 5, wherein said sign frame further comprises an upright sign post for supporting the flexible arms.

7. The self-deployable traffic sign system as recited in claim 5, wherein said sign frame further comprises a bottom portion.

8. The self-deployable traffic sign system as recited in claim 7, wherein the bottom portion is triangular.

9. The self-deployable traffic sign system as recited in claim 1, and further comprising a resilient mechanism on said support base.

10. The self-deployable traffic sign system as recited in claim 9, wherein said resilient mechanism comprises a spring.

11. The self-deployable traffic sign system as recited in claim 9, wherein said resilient mechanism assists in stabilizing said sign system when it is deployed in high-wind conditions.

12. The self-deployable traffic sign system as recited in claim 1, and further comprising means for remotely releasing said sign panel and support base from said receptacle in order to deploy said sign panel.

13. The self-deployable traffic sign system as recited in claim 1, wherein said receptacle is adapted to hold a single sign panel.

14. The self-deployable traffic sign system as recited in claim 1, wherein said receptacle is adapted to hold a plurality of sign panels.

15. The self-deployable traffic sign system as recited in claim 1, and further comprising a remote actuator for dispensing said sign panel from said receptacle.

16. A self-deployable traffic sign system, comprising:

a receptacle mountable to a vehicle;

a support base; and a reusable foldable sign pivotably mounted to said support base;

wherein said sign is pivotable to a spring-loaded storage position adjacent to said base and in the storage position is of a sufficiently small configuration to be disposed within said receptacle;

wherein said receptacle is pivotable in order to release and deploy said sign.

17. The self-deployable traffic sign system as recited in claim 16, wherein said receptacle is mounted to a hitch disposed on said vehicle.

18. The self-deployable traffic sign system as recited in claim 16, and further comprising a remote actuator for dispensing said sign panel from said receptacle.

19. A self-deployable traffic sign system, comprising: a receptacle mountable to a vehicle;

a support base; and a reusable foldable sign panel disposed on a foldable sign frame which is pivotably mounted to said support base, said sign frame comprising flexible arms on which said foldable sign panel is mounted and further comprising an upright sign post for supporting the flexible arms;

wherein said sign panel is pivotable to a spring-loaded storage position adjacent to said base and in the storage position is of a sufficiently small configuration to be disposed within said receptacle.

* * * * *